US007201282B1

(12) United States Patent
Alderman

(10) Patent No.: US 7,201,282 B1
(45) Date of Patent: Apr. 10, 2007

(54) SUSPENSION STORAGE RACK

(75) Inventor: Thomas E. Alderman, Lakeland, FL (US)

(73) Assignee: Suspenz, Inc., Atlanta, GA (US)

( * ) Notice: Subject to any disclaimer, the term of this patent is extended or adjusted under 35 U.S.C. 154(b) by 411 days.

(21) Appl. No.: 10/710,985

(22) Filed: Aug. 16, 2004

Related U.S. Application Data

(60) Provisional application No. 60/481,229, filed on Aug. 14, 2003.

(51) Int. Cl.
*A47F 7/00* (2006.01)
*A47F 1/14* (2006.01)

(52) U.S. Cl. ..... 211/60.1; 211/96; 211/100; 211/85.7; 211/70.5

(58) Field of Classification Search ..... 211/85.7, 211/103, 207, 193, 70.5, 96, 90.02, 99, 100, 211/104, 60.1, 150, 171; 224/563; 24/71 R, 24/68 PP, 68 CD
See application file for complete search history.

(56) References Cited

U.S. PATENT DOCUMENTS

| | | | |
|---|---|---|---|
| 1,380,570 | A | 6/1921 | Lehman |
| 3,164,255 | A | 1/1965 | Jay |
| 3,512,654 | A | 5/1970 | Olsen et al. |
| 4,426,011 | A | 1/1984 | Jay |
| 4,450,989 | A | 5/1984 | Boger, Jr. |
| 4,813,550 | A | 3/1989 | Saeks |
| 5,027,960 | A | 7/1991 | Rainville |
| 5,086,930 | A | 2/1992 | Saeks |
| 5,092,546 | A | 3/1992 | Wolfbauer |
| 5,145,135 | A | 9/1992 | Thompson |
| 5,833,079 | A | 11/1998 | Roberts |
| 5,950,844 | A | 9/1999 | Taylor |
| 6,138,841 | A | 10/2000 | Klein et al. |
| 6,164,465 | A | 12/2000 | Schroeder |
| 6,253,932 | B1 | 7/2001 | Lindsey |
| 6,390,309 | B1 | 5/2002 | Tucker |
| 2003/0178382 | A1 | 9/2003 | Tucker |

*Primary Examiner*—Jerry Redman
*Assistant Examiner*—Colleen M. Quinn
(74) *Attorney, Agent, or Firm*—Ronald E. Smith; Smith & Hopen, P.A.

(57) ABSTRACT

A storage rack is formed by a plurality of stacked modules where each module includes a vertical support column and a support arm that extends outwardly and downwardly from the vertical support column at an angle of about thirty degrees. A barrier arm is pivotally mounted to a distal free end of the support arm. A strap extends from a first, inner end of the support arm to the barrier arm. Elongate objects placed atop the strap cause the barrier arm to pivot into a vertical position to create a barrier that prevents objects from rolling or sliding in a direction away from the vertical support column. When the elongate object is lifted from the support arm, the tension in the strap is released and the barrier arm pivots into a horizontal position of repose to facilitate removal of the object from the support arms.

14 Claims, 6 Drawing Sheets

SUSPENSION STORAGE RACK

CROSS REFERENCE TO RELATED APPLICATION

This disclosure claims benefit of a pending provisional application filed by the same inventor on Aug. 14, 2003, bearing Ser. No. 60/481,229.

BACKGROUND OF THE INVENTION

This invention relates to storage racks for large, elongated objects such as recreational kayaks, canoes, sailboards, surfboards, cargo boxes, and the like. The novel storage rack may also hold pipes, missiles, and other substantially straight items.

One shortcoming of prior art racks or shelves is that they are difficult to load and unload. The item to be stored must be lifted to the height of the shelf upon which it is to be stored, or even higher if the rack includes an upwardly-extending barrier designed to prevent the stored item from rolling or sliding off the shelf.

Thus there is a need for a storage rack that is easier to load and unload than the storage racks of the prior art.

Many of the known storage racks are also of complex construction and thus are difficult to assemble and disassemble.

A need therefore exists for a storage rack of simple construction that is easy to assemble and disassemble.

The complex construction of the prior art storage racks is in part because such racks are not made of modular components. Moreover, they are typically made of bulky and heavy parts.

There is a need, therefore, for a storage rack made of modular components. The needed components should be made of strong yet light-in-weight materials that are weather-resistant and durable. It would also be advantageous if such parts could be injection molded.

However, in view of the prior art considered as a whole at the time the present invention was made, it was not obvious to those of ordinary skill in the mechanical arts how to produce a storage rack that supplies the needed features.

SUMMARY OF THE INVENTION

The long-standing but heretofore unfulfilled need for an improved storage rack is now fulfilled by a new, useful, and non-obvious invention.

The novel storage rack includes a vertical support column and a support arm formed integrally with the vertical support column. The support arm extends outwardly and downwardly from the vertical support column. More particularly, the support arm is disposed downwardly relative to a horizontal plane by about thirty degrees.

A barrier arm has a proximal end pivotally mounted to a distal free end of the support arm. A support strap extends between a proximal end of the support arm and a free distal end of the barrier arm in vertically spaced relation above the support arm. The barrier arm is disposed in a substantially horizontal disposition when the support strap is in a position of repose and the barrier arm is disposed in a substantially vertical position when the support strap is under tension. The barrier arm is in a substantially vertical position to prevent the elongate object from sliding from or rolling off the support arm when an elongate object is supported by the support arm. The support strap is under tension when the elongate object is so supported. The barrier arm is in a substantially horizontal position to facilitate removal of the elongate object from the storage rack when the elongate object is lifted from the support arm. Lifting the elongate object removes the tension from the support strap.

The vertical support column and the support arm collectively form a module. A first module is stacked in surmounting relation to a second module so that the first and second modules collectively form a first storage rack column. A third module is stacked in surmounting relation to a fourth module so that the third and fourth modules collectively form a second storage rack column. The first and second storage rack columns are disposed in laterally spaced relation to one another to collectively form a storage rack. The first and second storage rack columns may also be secured to one another in a back-to-back relation to collectively form a storage rack.

The support arm includes an upper support wall, a lower support wall disposed in parallel relation to the upper support wall, and a truss assembly including a plurality of horizontally and vertically disposed truss members that maintain the upper support wall and the lower support wall in said parallel relation to one another.

A top connector is disposed in surmounting relation to and formed integrally with the vertical support column.

The top connector has a width narrower than a width of the vertical support column; and the top connector is centered with respect to the width of the vertical support column.

An upper wall mount is adapted to be mounted to a vertical wall of a room. The upper wall mount includes a pair of laterally spaced apart walls adapted to slideably receive the top connector therebetween.

The top connector and the upper wall mount are adapted to receive at least one fastener that interconnects the top connector and the upper wall mount to one another.

A bottom connector is disposed at the bottom of and formed integrally with the vertical support column.

The bottom connector includes two walls disposed in laterally spaced relation to one another.

A lower wall mount is also adapted to be mounted to a vertical wall of a room. The lower wall mount includes a flat back wall adapted to abut the vertical wall of the room. A central wall is formed integrally with the back wall and extends therefrom in normal relation thereto. The two walls of the bottom connector are adapted to slideably receive the central wall of the lower wall mount therebetween. The bottom connector and the lower wall mount are adapted to receive at least one fastener that interconnects the bottom connector and the lower wall mount to one another.

A connector hump is formed on a front side of the top connector. The connector hump includes a narrow arcuate strip having a width substantially equal to the width of the top connector. The connector hump further includes a straight wall having a width substantially equal to a width of the vertical support column. The straight wall is formed integrally with a lowermost end of the narrow arcuate strip. The connector hump further includes a horizontally-disposed stand-off extending from about mid-length of the top connector to a juncture of the narrow arcuate strip and the straight wall. An uppermost end of the narrow arcuate strip is formed integrally with an uppermost end of the top connector and a lowermost end of the straight wall is formed integrally with a lowermost end of the top connector.

A vertical support column hump is formed on a front side of the vertical support column. The vertical support column hump includes a top wide arcuate wall, concave relative to the front side, having a top end formed integrally with the straight wall of the connector hump. The vertical support column hump further includes a middle wide arcuate wall, convex relative to the front side, having a top end formed integrally with a lower end of the top wide arcuate wall. The vertical support column hump also includes a bottom wide arcuate wall, concave relative to the front side, having a top end formed integrally with a lower end of the middle wide arcuate wall and having a lower end formed integrally with the top wall of the support arm.

An opening is formed in the middle wide arcuate wall and a first mounting means is formed in the middle wide arcuate wall on a first side of the opening. A second mounting means is formed in the middle wide arcuate wall on a second side of the opening. At least one peg has opposite ends respectively secured to the first and second mounting means. The support strap has a radially inner end secured to the at least one peg.

A quarter-circle wall extends from each wall of the pair of laterally spaced apart walls of the upper wall mount. Each quarter-circle wall is curved to match the curvature of the narrow arcuate strip.

A horizontally-disposed brace extends from a mid-point of the pair of laterally spaced apart bottom connector walls to the lower support wall.

The modular aspect of the structure provides an important advantage because it renders the storage rack portable.

Additional important advantages are conferred by the pivotally-mounted barrier arm and the support strap that actuates it. Specifically, the ability to lower the barrier arm out of the way when an object is being placed upon or removed from the novel storage rack is highly advantageous and was heretofore unknown.

These and other advantages will become more apparent as this disclosure continues.

The invention accordingly includes the combination of elements, arrangement of parts, and features of constructions set forth in the detailed description that follows, and the scope of the invention is indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
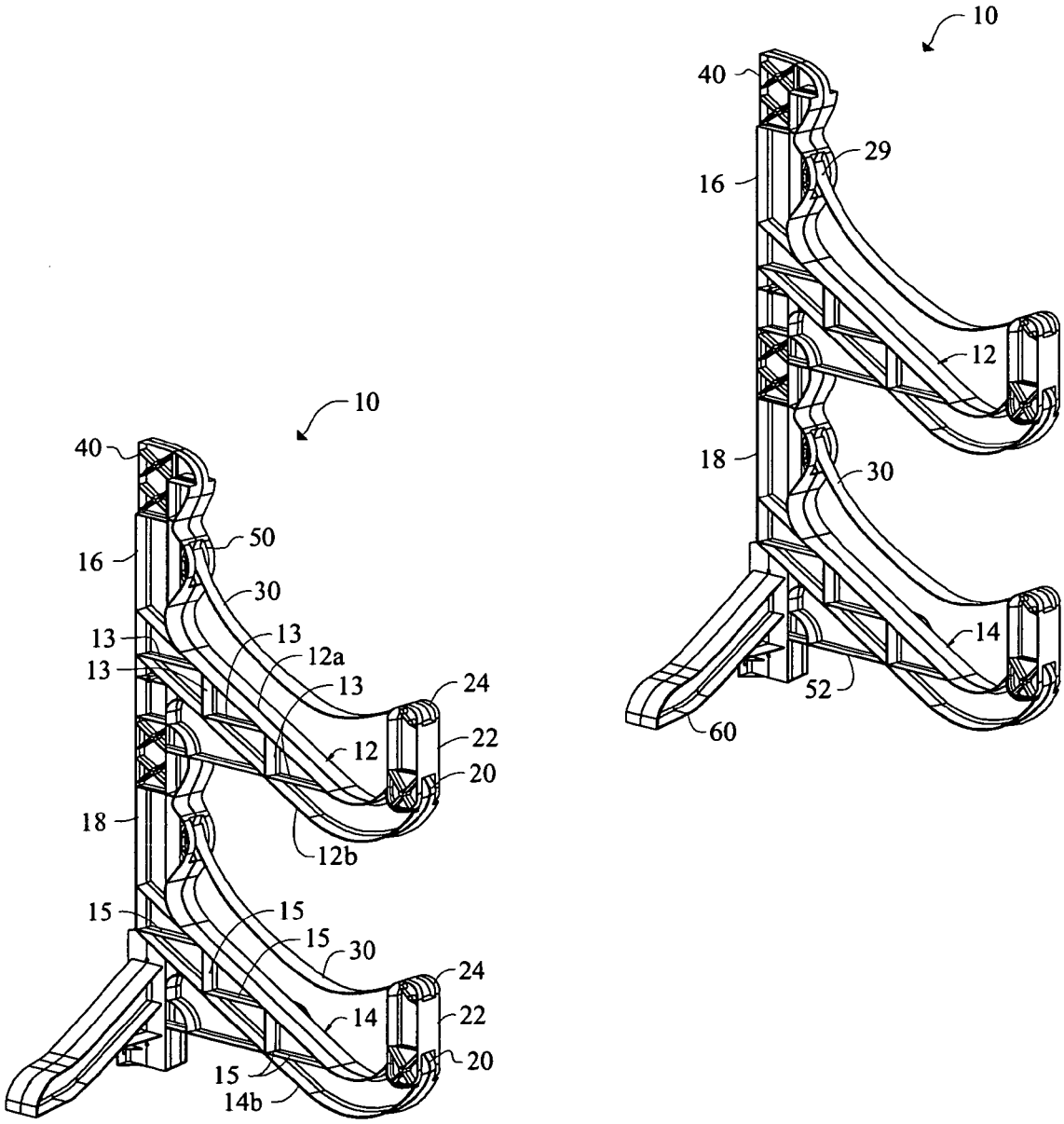
FIG. 1 is a perspective view depicting a pair of the novel floor-supported storage racks disposed in lateral relation to one another.

Referring now to FIG. 1, it will there be seen that a novel storage rack column is denoted as a whole by the reference numeral 10.

Figure 2:
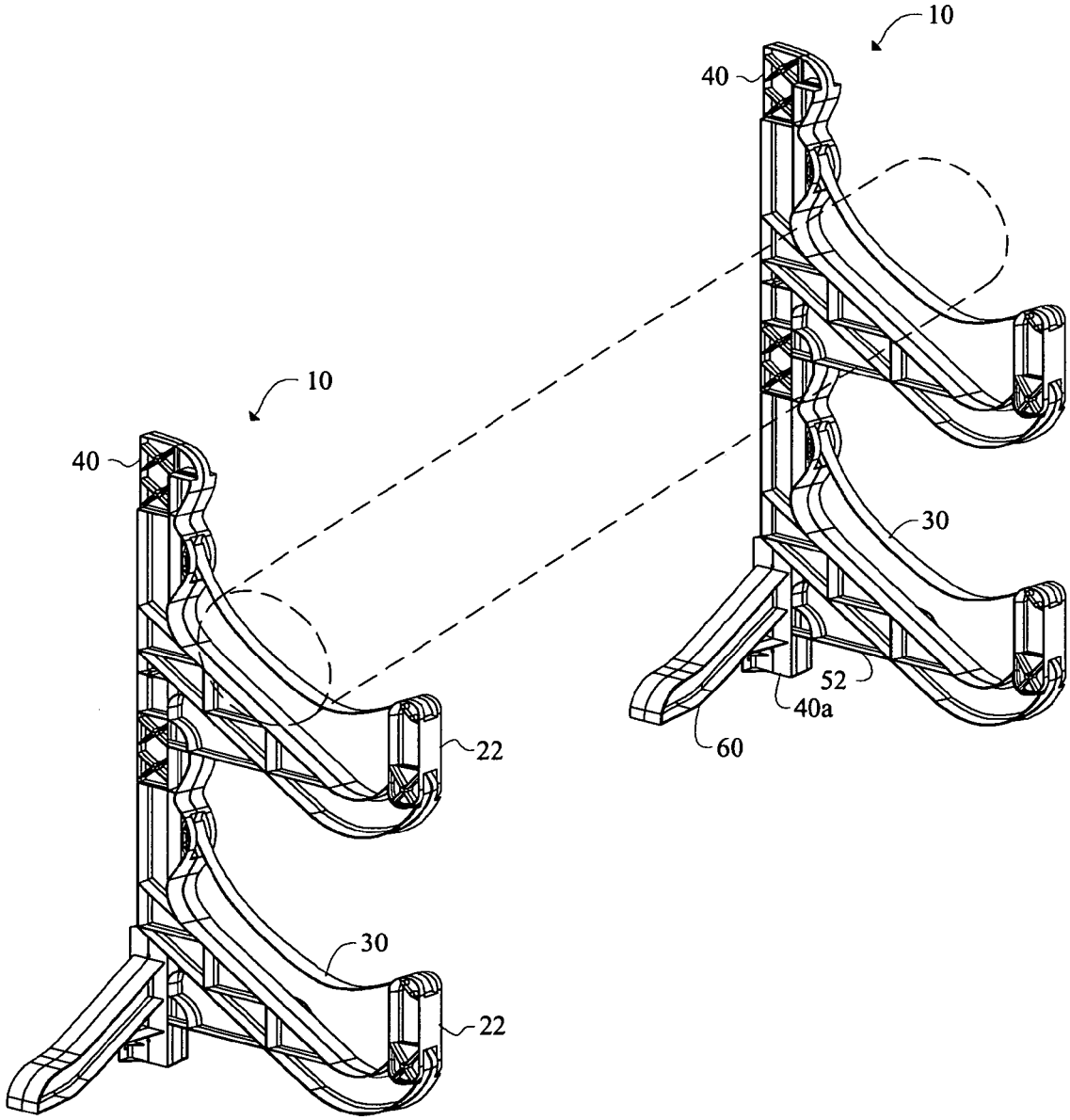
FIG. 2 is a view like that of FIG. 1 but depicting a cylindrical object supported at its opposite ends by upper support arms of the respective storage racks.

Two (2) of said storage rack columns 10 are placed in side-by-side relation to one another to form a simple storage rack, as depicted in FIGS. 1 and 2. Any number of such storage rack columns 10 may be employed to form larger storage racks. They may also be secured to one another in a back-to-back relation.

Storage rack column 10 is formed of a plurality of storage rack modules. Each storage rack module includes a support arm that extends in cantilever fashion from a vertical support column. In the example of FIG. 1, each storage rack column 10 includes two (2) storage rack modules. Upper support arm 12 is a part of the first module and lower support arm 14 is a part of the second module.

Upper support arm 12 is formed integrally with vertical support column 16 and lower support arm 14 is formed integrally with vertical support column 18. Upper support arm 12 and lower support arm 14 are angled downwardly with respect to horizontal by about thirty degrees (30°).

Upper support arm includes upper support wall 12*a* and lower support wall 12*b*. Horizontally and vertically disposed truss members 13 collectively form a truss that imparts strength to upper support arm 12.

Lower support arm 14 includes upper support wall 14*a* and lower support wall 14*b*. Horizontally and vertically disposed truss members 15 collectively form a truss that imparts strength to lower support arm 14.

Figure 3:
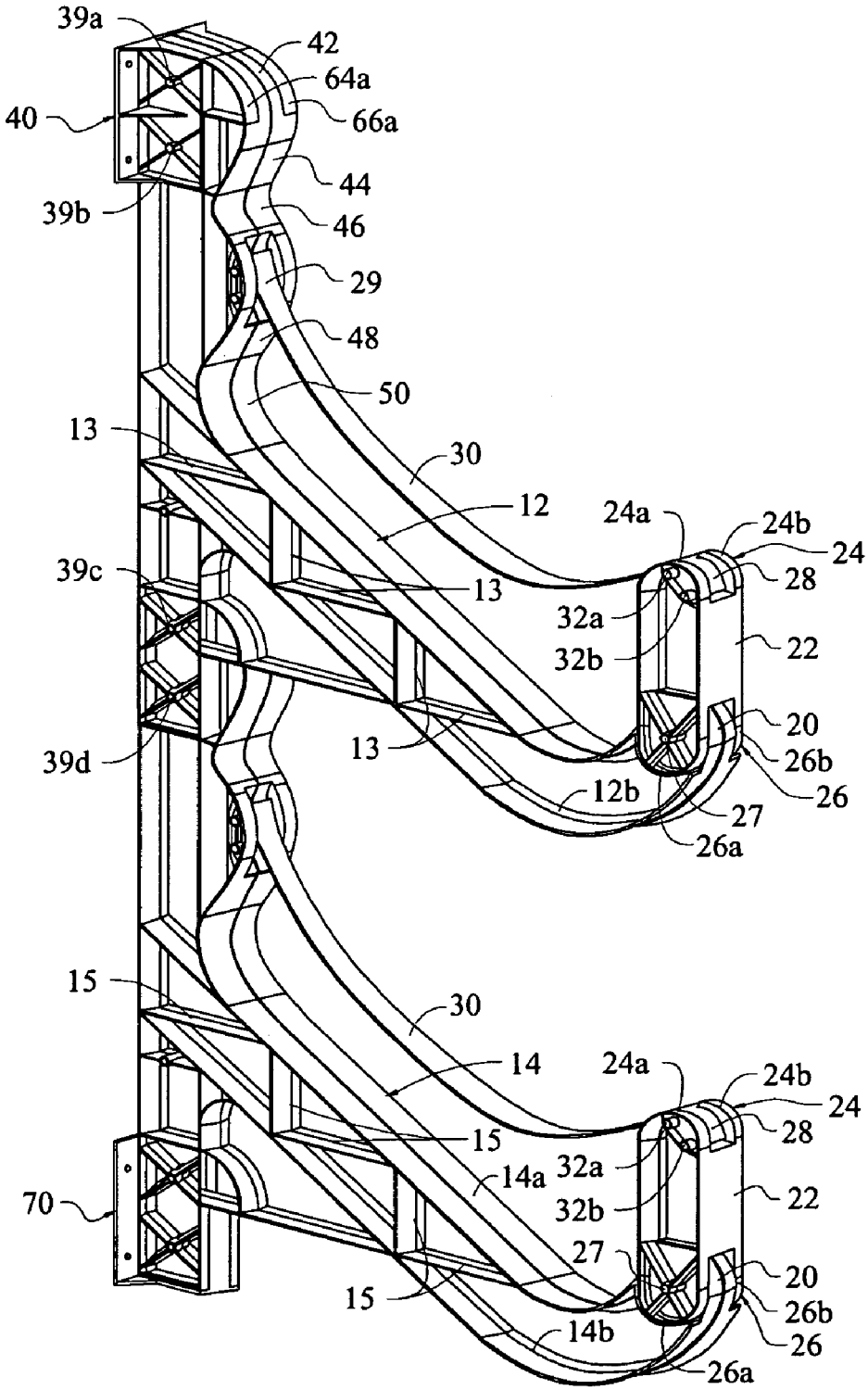
FIG. 3 is a perspective view of a wall-mounted embodiment.

As perhaps best depicted in FIG. 3, the respective distal ends of upper support wall 12*a* and lower support wall 12*b* are joined to one another by a return bend wall 20 having a width about half the width of said upper and lower support walls.

Barrier arm 22 is bifurcated at its top 24 and bottom 26.

Figure 4A:
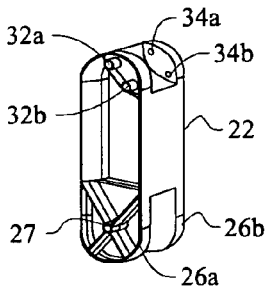
FIG. 4A is a perspective view of the novel pivot arm.

Top 24 includes a pair of laterally spaced apart rounded walls 24*a*, 24*b* that accommodate distal end 28 of support strap 30. Eyelets 32*a*, 32*b* (see FIG. 4A and FIG. 5) are connected to rounded wall 24*a* and a pair of matching blind bores 34*a*, 34*b* are formed in rounded wall 24*b*. Said eyelets and blind bores capture opposite ends of a pair of pegs, not shown, about which said distal end 28 of support strap 30 is wrapped.

There are numerous other ways to mount the opposite ends of said pegs, and all of such ways are within the scope of this invention. For example, instead of eyelets for capturing a first end of a peg and a blind bore formed in a solid wall for capturing a second end thereof, both ends could be captured in eyelets or both ends could be captured in blind bores or through bores. The use of eyelets saves materials.

Bottom 26 of barrier arm 22 also includes a pair of laterally spaced apart rounded walls 26*a*, 26*b*. Walls 26*a*, 26*b* accommodate return bend wall 20. Said return bend wall 20 is centrally apertured to accommodate an axle having its opposite ends mounted in central hub 27 that is formed integrally with rounded wall 26*a* and a central blind bore, not shown, formed in rounded wall 26*b*. Any other mechanical structure that provides a pivotal mount for barrier arm 22 is within the scope of this invention. For example, eyelets could be employed to save materials.

The length of support strap 30 is preselected so that barrier arm 22 is vertically disposed when said strap is under load, i.e., when a load is imposed upon said strap. Strap 30 is horizontally disposed when strap 30 is in repose, i.e., when no load is imposed thereupon. Thus, an elongate object is captured atop upper support arm 12 by said upstanding barrier arm and thus cannot roll off or slide from said upper support arm. However, lifting the elongate object from strap 30 allows barrier arm 22 to fall into its horizontal position of repose, thereby facilitating removal of the object from said support arm. This eliminates a need to lift the object over an upright barrier arm 22.

Figure 5:
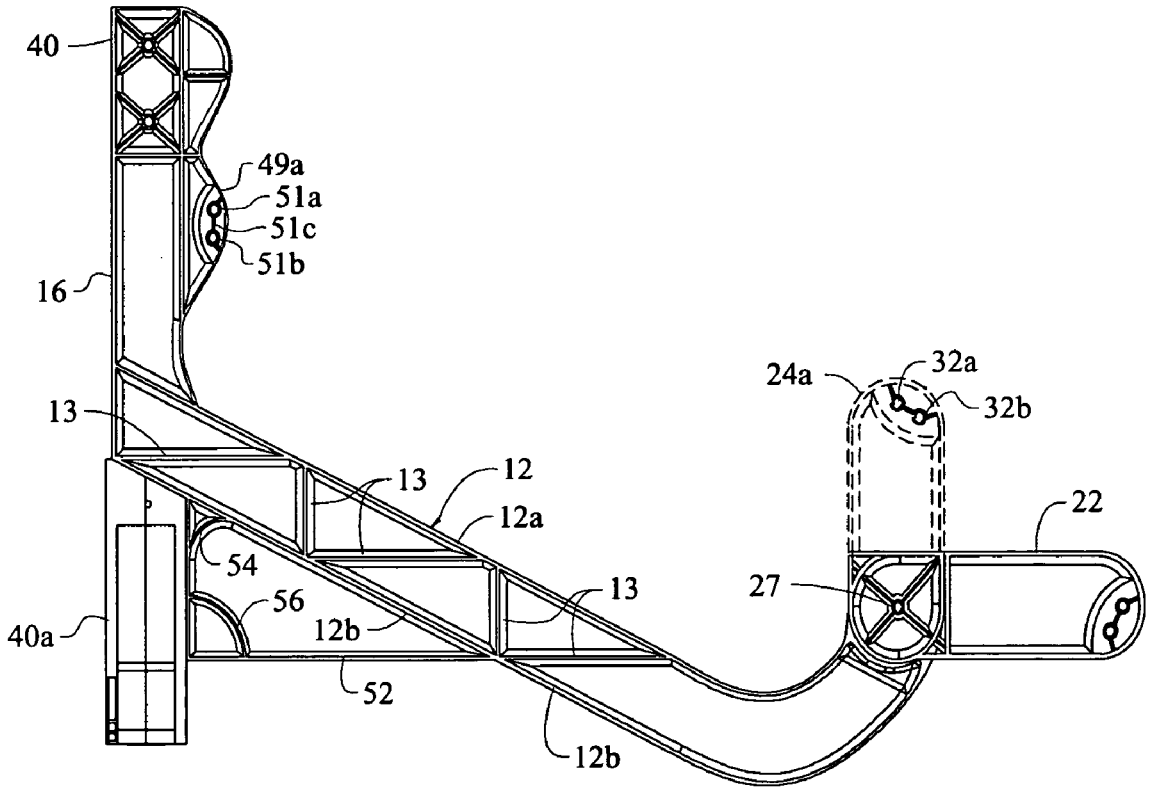
FIG. 5 is a side elevational view of the novel support arm, depicting the pivot arm when in its upright position in dotted lines and in its horizontal position in solid lines.
Figure 6:
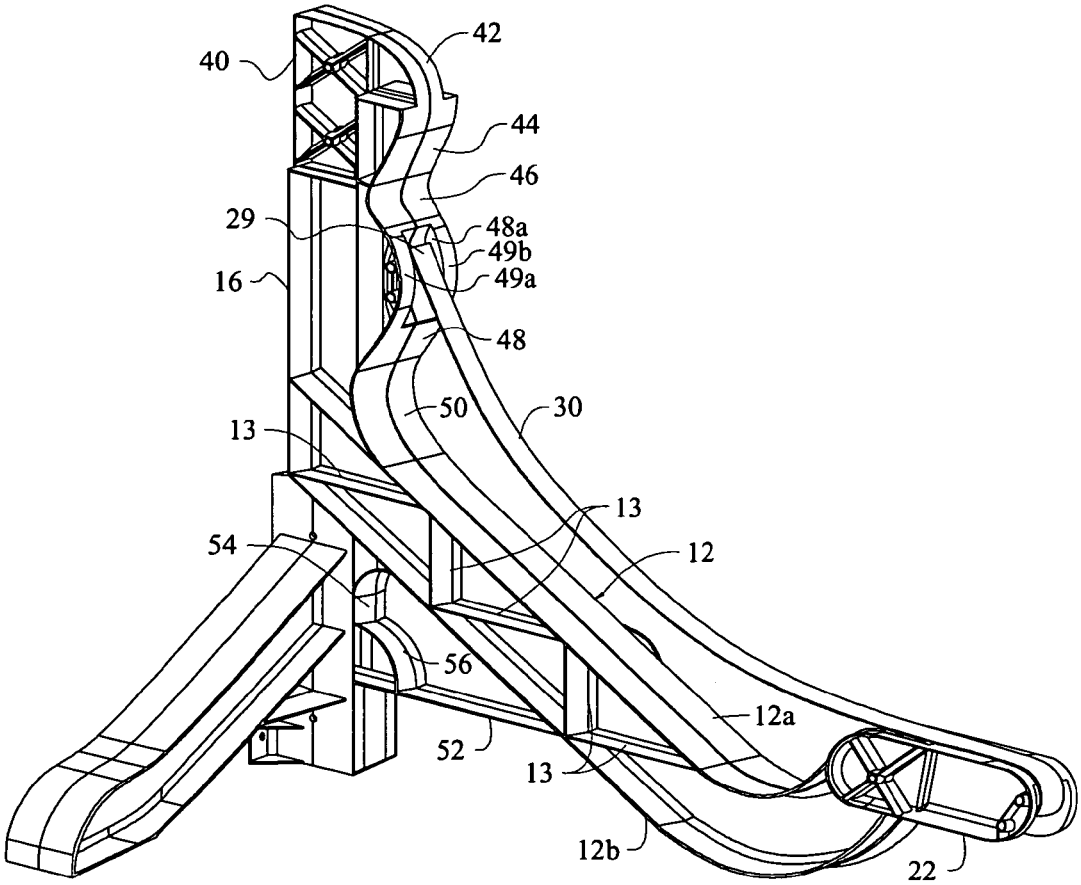
FIG. 6 is a perspective view of a single support arm, floor-standing embodiment of the invention.

Straps 30 are made of a suitable non-rigid, strong material that conforms to hulls of varying widths and depths. As depicted in FIG. 5, barrier arm 22 pivots open when unloading to increase clearance, and pivots closed when the weight of a boat or other large object is applied to straps 30 during loading. This pivot feature enhances the safety of side access loading by minimizing lifting height.

Connector 40 surmounts and is formed integrally with vertical support column 16. Connector 40 has a width that is about half the width of vertical support column 16 and said connector 40 is centered with respect to said width of said connector. A pair of unnumbered "X"-shaped braces are formed integrally with box-like connector 40 and maintain its structural integrity. Any other mechanical means for maintaining the structural integrity of connector 40 is within the scope of this invention. Eyelet 39*a* is formed at the central hub of the upper "X"-shaped brace and eyelet 39*b* is formed at the central hub of the lower "X"-shaped brace. Eyelets 39*a*, 39*b* respectively receive fastener means when connector 40 is mounted to a wall in a manner disclosed hereinafter. As mentioned above, the eyelets are not critical to the invention and may be replaced by other suitable means for receiving a peg, a fastener, or the like. For example, a flat solid wall having a central throughbore formed therein could replace each eyelet 39*a*, 39*b*.

A first generally convex protrusion or hump, generally denoted 41, also referred to herein as the connector hump, is formed on the front side of connector 40. First hump 41 includes narrow arcuate strip 42 having the same width as connector 40 (see FIG. 4D) and a wide straight wall 44 having a width about equal to the width of central support column 16. Horizontally-disposed stand-off 46 extends from mid-length of connector 40 to the juncture of narrow arcuate strip 42 and wide straight wall 44.

A second generally convex protrusion or hump, generally denoted 43, also referred to herein as the vertical support column hump, is formed on a front side of vertical support column 16. Vertical support column hump 43 includes a top wide arcuate wall 46, concave relative to said front side, having a top end formed integrally with wide straight wall 44, a middle wide arcuate wall 48, convex relative to said front side, having a top end formed integrally with a lower end of top wide arcuate wall 46, and a bottom wide arcuate wall 50, concave relative to said front side, having a top end formed integrally with a lower end of said middle wide arcuate wall 48 and having a lower end formed integrally with top wall 12*a* of upper support arm 12.

Opening 48*a* is formed in middle wide arcuate wall 48, thereby defining convex walls 49*a*, 49*b* on opposite sides of said opening 48*a*. As best depicted in FIG. 5, eyelets 51*a*, 51*b* are mounted on mounting strip 51*c*, said mounting strip having its opposite ends formed integrally with convex wall 49*a*. As best understood in connection with FIG. 4E, a pair of blind bores, not numbered to avoid further clutter, are disposed laterally opposite eyelets 51*a*, 51*b*, said blind bores being formed in a sidewall, also not numbered, that is formed integrally with convex wall 49*b*.

A first and a second peg, not shown, extend between eyelets 51*a*, 51*b* and said blind bores in parallel relation to one another. Radially inner end 29 of support strap 30 is secured to said pegs. Any other mechanical structure for securing radially inner end 29 is also within the scope of this invention.

Straps 30 are adjustable in length to conform to hulls or other surfaces of varying widths and depths.

Figure 4B:
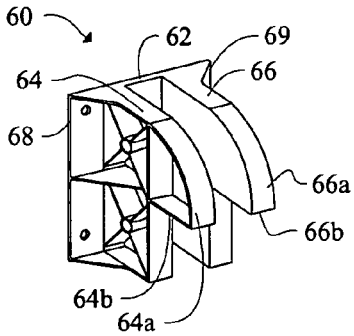
FIG. 4B is a perspective view of the novel lower wall mount.
Figure 4C:
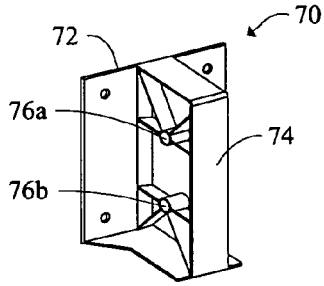
FIG. 4C is a perspective view of the novel upper wall mount.
Figure 4D:
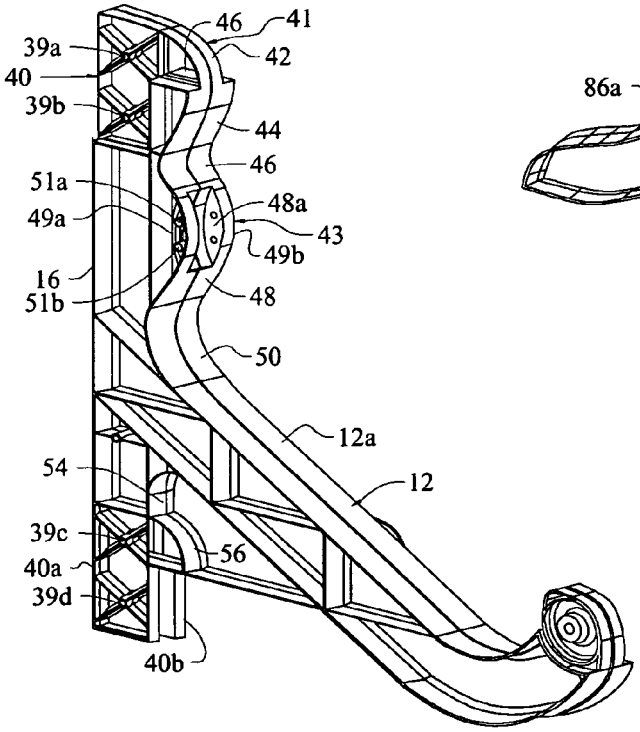
FIG. 4D is a perspective view of the novel floor-supported base.

As best depicted in FIG. 4D, a pair of laterally spaced apart connectors 40*a*, 40*b*, having the same structure as single connector 40 that surmounts central post 16, are formed integrally with the lower end of central support post 16. Horizontal brace 52 extends from a mid-point of connectors 40*a* to lower support wall 12*b* with which it is integrally formed so as to be co-planar with the lowermost horizontal brace of truss system 13 as depicted. Convex support arm 54 interconnects lower support wall 12*b* to central support post 16 and arcuate support arm 56 interconnects said central support post to horizontal brace 52.

The novel storage rack may be wall-mounted or floor-mounted. Upper wall mount 60 is depicted in FIG. 4B and lower wall mount 70 is depicted in FIG. 4C.

Upper wall mount 60 has a flat back wall 62 that abuts a vertical wall to which a storage rack column 10 is mounted. Open frame walls 64, 66 are formed integrally with back wall 62 and extend normal thereto in laterally spaced relation to one another by a distance substantially equal to the width of connector 40. An unnumbered upper eyelet is centered in the top half of wall 64 and an unnumbered lower eyelet is centered in the lower half of said wall 64, said eyelets being the central hubs, respectively, of upper and lower "X"-shaped braces. Upper and lower eyelets are also formed in the same way in the upper and lower halves of open frame wall 66. These eyelets align with upper and lower eyelets 39*a*, 39*b* formed in open frame connector 40 that is formed integrally with and that surmounts vertical support column 16. Suitable fasteners extend through these aligned eyelets to lock upper wall mount 60 to said connector 40.

Quarter-circular wings 66*a*, 66*b* are formed integrally with walls 64, 66, respectively, and are curved to match the curvature of narrow arcuate strip 42. The respective edges 64*b*, 66*b* of said wings 66*a*, 66*b* abut standoff 46 when connector 40 is fully received between walls 64 and 66. Flanges 68 and 69 are coplanar with back wall 62 and are apertured as depicted to receive conventional fasteners. The apertures are not numbered to avoid clutter in the drawings. Also unnumbered are horizontally disposed, vertically spaced braces that interconnects wall 64 and flange 68. Similar unnumbered and undepicted braces interconnect wall 66 and flange 69.

Lower wall mount 70 has back wall 72 that has unnumbered apertures formed therein to receive conventional fasteners. Central wall 74 is disposed normal to said back wall 72 and has a width substantially equal to the space between connectors 40*a*, 40*b* formed integrally with the lower end of vertical support column 16 and is snugly received between them. Eyelets 76*a*, 76*b* are aligned with eyelets 39*c*, 39*d* formed in connectors 40*a*, 40*b* when central wall 74 is so disposed. Suitable fasteners extend through said aligned eyelets to lock lower wall mount 70 to connectors 40*a*, 40*b*.

Instead of mounting upper wall mount 60 and lower wall mount 70 to a wall, a pair of upper wall mounts and a pair of lower wall mounts may be secured to one another in back-to-back relation, thereby forming a two (2) rack system where the racks are back-to-back to one another, in a free-standing configuration. In this way, the racks support one another and there is no need to attach them to a wall.

Figure 4E:
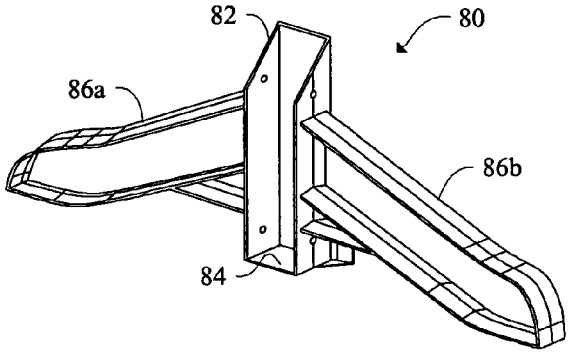
FIG. 4E is a perspective view of the novel support arm.

Base 80, depicted in FIG. 4E, includes a channel-like member 82 having an open top and a closed bottom wall 84. Channel member 82 slideably receives connectors 40*a*, 40*b* formed integrally with the lower end of either vertical support column 16 or 18. A pair of supports 86*a*, 86*b* extend laterally from said member 82, thereby creating a three (3) point stable base defined by the respective outermost ends of said supports 86*a*, 86*b* and the lowermost end of said member 82.

A pair of the novel storage racks 10 equipped with straps 30 and barrier arm 22 will suspend a kayak in an optimal manner. Suspension is the recommended storage method for kayaks because straps 30 evenly distribute hull weight to prevent the hull from warping. Straps 30 also prevent the hull from resting on a hard surface, thereby protecting the hull from abrasion. A pair of racks 10 will also hold a canoe turned hull side up on its gunwales. This is the recommended storage method for canoes since it keeps the hull from warping.

The modular unit formed by support column 16 and support arm 12 has the same structure as the modular unit formed by support column 18 and support arm 14. These modular units can be used alone or they can be vertically stacked and bolted together. Accordingly, no long central column is required. Storage rack 10 is portable because its modular parts can be quickly and easily assembled and disassembled.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween. Now that the invention has been described,

The invention claimed is:

1. A storage rack, comprising: a vertical support column; a support arm formed integrally with said vertical support column; said support arm extending outwardly and downwardly from said vertical support column; a barrier arm having a proximal end pivotally mounted to a distal free end of said support arm; a support strap extending between a proximal end of said support arm and a free distal end of said barrier arm in vertically spaced relation above said support arm; said barrier arm being disposed in a substantially horizontal disposition when said support strap is in a position of repose; and said barrier arm being disposed in a substantially vertical position when said support strap is under tension; said barrier arm being in said substantially vertical position to prevent said elongate object from sliding from or rolling off said support arm when an elongate object is supported by said support arm, said support strap being under tension when said elongate object is so supported; and said barrier arm being in said substantially horizontal position to facilitate removal of said elongate object from said storage rack when said elongate object is lifted from said support arm, said lifting removing said tension from said support strap.

2. The storage rack of claim 1, further comprising: said vertical support column and said support arm collectively defining a module; a first module being stacked in surmounting relation to a second module so that said first and second modules collectively form a first storage rack column; a third module being stacked in surmounting relation to a fourth module so that said third and fourth modules collectively form a second storage rack column; said first and second storage rack columns being disposed in cooperative relation to one another to collectively form said storage rack.

3. The storage rack of claim 1, further comprising: said support arm being disposed downwardly relative to a horizontal plane by about thirty degrees.

4. The storage rack of claim 1, further comprising: said support arm including an upper support wall, a lower support wall disposed in parallel relation to said upper support wall, and a truss assembly including a plurality of horizontally and vertically disposed truss members that maintain said upper support wall and said lower support wall in said parallel relation to one another.

5. The storage rack of claim 1, further comprising: a top connector disposed in surmounting relation to and formed integrally with said vertical support column; said top connector having a width narrower than a width of said vertical support column; and said top connector being centered with respect to said width of said vertical support column.

6. The storage rack of claim 5, further comprising: an upper wall mount adapted to be mounted to a vertical wall of a room; said upper wall mount including a pair of laterally spaced apart wall members adapted to slideably receive said top connector therebetween; said top connector and said upper wall mount being adapted to receive at least one fastener that interconnects said top connector and said upper wall mount to one another.

7. The storage rack of claim 1, further comprising: a bottom connector disposed at the bottom of and formed integrally with said vertical support column; said bottom connector including two walls disposed in laterally spaced relation to one another.

8. The storage rack of claim 7, further comprising: a lower wall mount adapted to be mounted to a vertical wall of a room; said lower wall mount including a flat back wall adapted to abut said vertical wall of a room; a central wall formed integrally with said back wall and extending therefrom in normal relation thereto; said two walls of said bottom connector being adapted to slideably receive said central wall of said lower wall mount therebetween; and said bottom connector and said lower wall mount being adapted to receive at least one fastener that interconnects said bottom connector and said lower wall mount to one another.

9. The storage rack of claim 5, further comprising: a connector hump formed on a front side of said top connector; said connector hump including a narrow arcuate strip having a width substantially equal to said width of said top connector; said connector hump further including a straight wall having a width substantially equal to a width of said vertical support column, said straight wall formed integrally with a lowermost end of said narrow arcuate strip; said connector hump further including a horizontally-disposed stand-off extending from about mid-length of said top connector to a juncture of said narrow arcuate strip and said straight wall; an uppermost end of said narrow arcuate strip being formed integrally with an uppermost end of said top connector; and a lowermost end of said straight wall being formed integrally with a lowermost end of said top connector.

10. The storage rack of claim 9, further comprising: a vertical support column hump formed on a front side of said vertical support column; said vertical support column hump including a top wide arcuate wall, concave relative to said front side, having a top end formed integrally with said straight wall of said connector hump; said vertical support column hump including a middle wide arcuate wall, convex relative to said front side, having a top end formed integrally with a lower end of said top wide arcuate wall; and said vertical support column hump including a bottom wide arcuate wall, concave relative to said front side, having a top end formed integrally with a lower end of said middle wide arcuate wall and having a lower end formed integrally with said top wall of said support arm.

11. The storage rack of claim 10, further comprising: an opening formed in said middle wide arcuate wall; a first mounting means formed in said middle wide arcuate wall on a first side of said opening; a second mounting formed in said middle wide arcuate wall on a second side of said opening; at least one peg having opposite ends respectively secured to said first and second mounting means; said support strap having a radially inner end adjustably secured to said at least one peg.

12. The storage rack of claim 6, further comprising: a quarter-circle wall extending from each wall of said pair of laterally spaced apart walls of said upper wall mount; each quarter-circle being curved to match the curvature of said narrow arcuate wall.

13. The storage rack of claim 7, further comprising: a horizontally-disposed brace extending from a mid-point of said pair of laterally spaced apart bottom connector walls to said lower support wall.

14. The storage rack of claim 13, further comprising: a first arcuate support arm interconnecting said lower support wall to said vertical support column; a second arcuate support arm interconnecting said vertical support column to said horizontally-disposed brace.

* * * * *